US006286741B1

(12) United States Patent
Itoh

(10) Patent No.: US 6,286,741 B1
(45) **Date of Patent: *Sep. 11, 2001**

(54) METHOD OF FEEDING A PHOTOSENSITIVE MATERIAL IN A PHOTOSENSITIVE MATERIAL PROCESSING DEVICE

(75) Inventor: Koji Itoh, Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/138,672

(22) Filed: Aug. 24, 1998

(30) Foreign Application Priority Data

Aug. 25, 1997 (JP) ..... 9-227896

(51) Int. Cl.[7] ..... B65H 20/00
(52) U.S. Cl. ..... 226/186; 226/177
(58) Field of Search ..... 492/56, 18, 17; 101/463.1, 401.1; 430/309; 226/186, 177, 791

(56) References Cited

U.S. PATENT DOCUMENTS 3,572,570 * 3/1971 Mortensen et al. ..... 226/177
3,771,738 * 11/1973 Abbey ..... 242/419.5
4,921,155 * 5/1990 Ito et al. ..... 226/181
5,019,203 * 5/1991 Singer ..... 226/177
5,160,410 * 11/1992 Tammi et al. ..... 162/358.1
5,522,785 * 6/1996 Kedl et al. ..... 492/21
5,782,730 * 7/1998 Kawasaki et al. ..... 492/56
5,797,322 * 8/1998 Lorig et al. ..... 101/375
5,813,345 * 9/1998 Fuller et al. ..... 101/463.1
5,913,471 * 6/1999 Makosch et al. ..... 226/186
5,967,512 * 10/1999 Irsik ..... 271/273
5,978,010 * 11/1999 Hosokawa ..... 347/250
6,024,019 * 2/2000 Williams et al. ..... 101/463.1

* cited by examiner

*Primary Examiner*—S. Thomas Hughes
*Assistant Examiner*—Marc W. Butler
(74) *Attorney, Agent, or Firm*—Sughrue, Mion, Zinn, Macpeak & Seas, PLLC

(57) ABSTRACT

A method of feeding a photosensitive material processing device, includes providing a pair of feed rollers, each in a form of a coaxially-shaped two-layer structure formed by two-layers extrusion molding using thermoplastic resin, wherein the two-layer structure of each of the feed rollers has an internal layer portion and an external layer portion wherein the modulus of elasticity of either the thermoplastic resin constituting the external layer portion or the thermoplastic resin constituting the internal layer portion of the two-layer structure is 240 kgf/mm$^2$ or more, the modulus of elasticity of the thermoplastic resin constituting the other layer portion is 900 kgf/mm$^2$ or more, and the external diameter of one of the feed rollers is 13.7 mm or more. The feed rollers are rotatably supported on a processing rack inside a processing tank of the device so that the rollers oppose one another, with a predetermined clearance, and the photosensitive material is directed between the feed rollers, while rotating at least one of the rollers, to convey the photosensitive material inside the processing tank.

20 Claims, 3 Drawing Sheets

METHOD OF FEEDING A PHOTOSENSITIVE MATERIAL IN A PHOTOSENSITIVE MATERIAL PROCESSING DEVICE

BACKGROUND OF THE INVENTION

1. Field of the Invention

The present invention relates to a low-cost feed roller structure which can reliably transport a photosensitive material while maintaining the accuracy of the roller, and is preferably used in, for example, a printer-processor and the like.

2. Description of the Related Art

For example, a plurality of processing tanks which contain processing solutions or water for color development, bleach-fixing, rinsing, stabilization, and the like are provided in a photosensitive material processing apparatus (e.g., a printer-processor and the like) serving as an automatic processor. As a photosensitive material such as photographic printing paper or the like is successively conveyed into these processing tanks, the photosensitive material is processed.

Namely, a processing rack provided with a multiplicity of feed roller pairs is inserted into each processing tank. These feed rollers nip and transport the photosensitive materials for processing.

Recently, however, the use of photosensitive materials with broad widths, which is becoming increasingly desired, necessitates that the roller surface length, i.e. the length in the direction of the axis of the feed roller be lengthened so as to process these broad photosensitive materials.

However, if a conventional roller, which is formed in a pipe shape by extrusion molding of a resin material, is simply lengthened to broaden the roller surface length, then the concern arises that the deflection of the central part of the feed roller will become too marked and transportation failure, inclination, meandering, and the like of a photosensitive material may occur. A highly rigid metal pipe, rod or the like may be inserted into the core of the feed roller to increase the rigidity thereof so that the deflection can be reduced, however, if a metal pipe or the like is inserted into a feed roller, the manufacturing cost of the feed roller is disadvantageously increased.

SUMMARY OF THE INVENTION

In view of the aforementioned fact, an object of the present invention is to obtain a low-cost feed roller structure which can reliably transport a photosensitive material while maintaining the accuracy of the roller.

According to a first aspect of the present invention, a feed roller structure comprises a roller, having a coaxially-shaped two-layer structure formed by two-layer extrusion molding using thermoplastic resin, which is rotatably supported on a processing rack and feeds a photosensitive material inside a processing tank, wherein the two-layer structure of the feed roller comprises an internal layer portion and an external layer portion wherein the modulus of elasticity of either the thermoplastic resin constituting the external layer portion of the two-layer structure or the modulus of elasticity of the thermoplastic resin constituting the internal layer portion of the two-layer structure is 240 kgf/mm$^2$ or more, the modulus of elasticity of the thermoplastic resin constituting the other layer portion is 900 kgf/mm$^2$ or more, and the external diameter of the feed roller is 13.7 mm or more.

According to a second aspect of the present invention, a feed roller structure comprises a roller, having a coaxially-shaped two-layer structure formed by two-layer extrusion molding using thermoplastic resin, which is rotatably supported on a processing rack and feeds a photosensitive material inside a processing tank, wherein the two-layer structure of the feed roller comprises an internal layer portion and an external layer portion wherein the modulus of elasticity of the thermoplastic resin constituting the external layer portion of the two-layer structure is 240 kgf/mm$^2$ or more, the modulus of elasticity of the thermoplastic resin constituting the internal layer portion of the two-layer structure is 900 kgf/mm$^2$ or more, and the external diameter of the feed roller is within the range of from 13.7 mm to 45 mm.

In the feed roller structure of the present invention, a coaxially-shaped two-layer structure formed using thermoplastic resins, having a layer with a low modulus of elasticity and a layer with a high modulus of elasticity obviates the need for the insertion of a core such as a metal pipe or the like so that reduced manufacturing costs are achieved.

In the present invention, the modulus of elasticity is 240 kgf/mm$^2$ or more in the layer with the low modulus of elasticity, and the modulus of elasticity is 900 kgf/mm$^2$ or more in the layer with the high modulus of elasticity.

In the feed roller structure of the present invention, a two-layer structure is formed from a layer with a low modulus of elasticity and a layer with a high modulus of elasticity. The layer with a low modulus of elasticity is preferably formed using a simple thermoplastic resin substance, and is preferably formed using olefinic elastomer. The layer with a high modulus of elasticity has a modulus of elasticity of 900 kgf/mm$^2$ or more, and is preferably formed using thermoplastic resin containing fillers.

In the feed roller structure of the present invention, a two-layer structure is formed from an external layer portion with a low modulus of elasticity and an internal layer portion with a high modulus of elasticity. The external layer portion is preferably formed using a simple thermoplastic resin substance, and is preferably formed using olefinic elastomer. The internal layer portion has a modulus of elasticity of 900 kgf/mm$^2$ or more, and is preferably formed using thermoplastic resin containing fillers.

In the feed roller structure of the present invention, the external diameter of the roller is 13.7 mm or more, and preferably, the nip surface length is within the range of from 230 mm to 400 mm. In the feed roller structure of the present invention, when the external diameter of a roller is A, the internal diameter of the external layer is B, and the internal diameter of the internal layer is C, their ratio is preferably within the range of A:B:C=10:8 to 9.4:5 to 7.3.

In the feed roller of the present invention, the rigidity of the feed roller is enhanced by providing a layer having a high modulus of elasticity while maintaining the minimum external diameter of the feed roller so that the photosensitive material can be reliably transported while the accuracy of the roller is maintained when the feed roller, which is rotatably supported by a processing rack, nips and transports the photosensitive material inside a processing tank, without the occurrence of transportation failure, meandering, and the like of the photosensitive material.

In the feed roller structure of the present invention, when the external diameter of a roller is A, the internal diameter of the external layer portion is B, and the internal diameter of the internal layer portion is C, their ratio is preferably within the range of A:B:C=10:8 to 9.4:5 to 7.3, whereby a feed roller, which not only has a high rigidity but also has a superior workability, can be formed.

The manufacturing costs of the feed roller can be further reduced by forming the layer with the low modulus of elasticity using low-cost olefinic elastomer. Further, in the feed roller of the present invention, a layer with a high modulus of elasticity is formed using thermoplastic resin containing fillers to thereby obtain a highly rigid feed roller with a modulus of elasticity of 900 kgf/mm$^2$ or more.

DESCRIPTION OF THE PREFERRED EMBODIMENTS

The feed roller structure according to an embodiment of the present invention will be described in accordance with the drawings.

Figure 1:
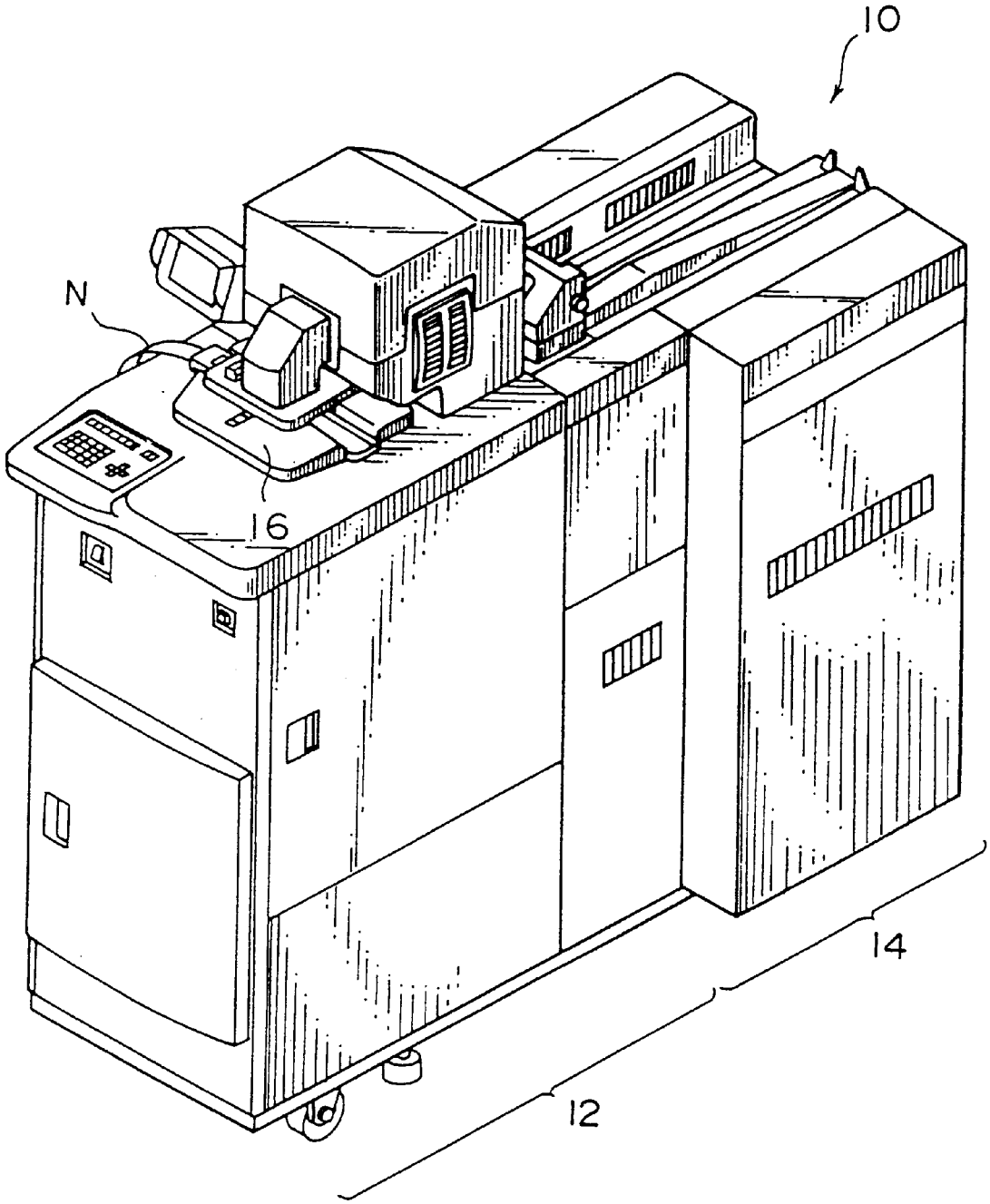
FIG. 1 is a perspective view of a printer-processor according to an embodiment of the present invention.

FIG. 1 shows a perspective view of a schematic overall structure of a printer-processor 10 serving as a photosensitive material processing apparatus wherein a feed roller structure of the present embodiment is used.

The printer-processor 10 comprises a printer section 12 and a processor section 14. In the printer section 12, images on a negative film N loaded in a negative carrier 16 are printed onto unillustrated photographic printing paper P serving as a photosensitive material. The photographic printing paper P is conveyed to the processor section 14.

In the processor section 14, a developing tank, a bleach-fixing tank, a rinsing tank and a drying section (not shown in FIG. 1) are provided, wherein the photographic printing paper P conveyed from the printer section 12 is processed.

Figure 2:
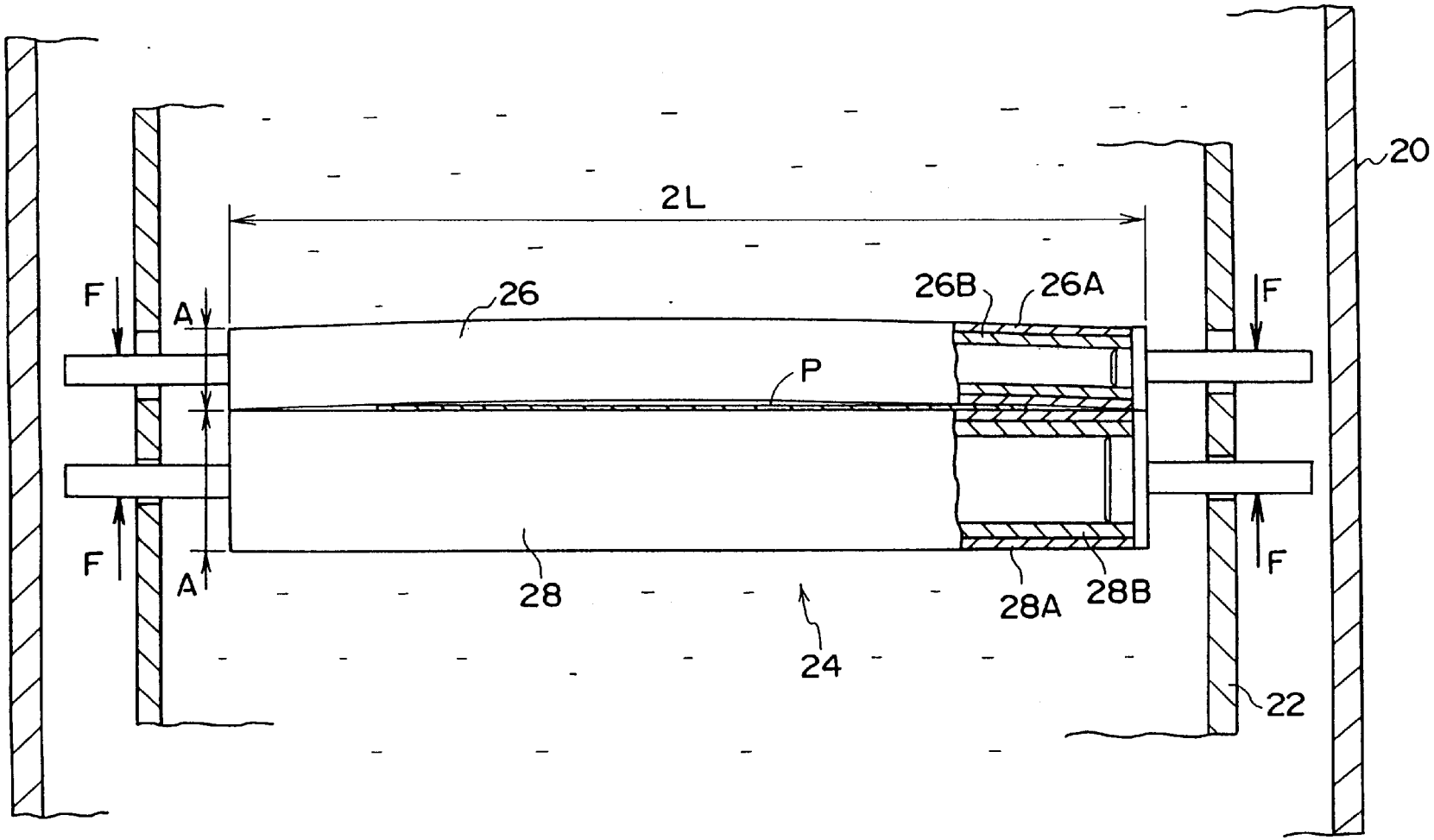
FIG. 2 is a cross-sectional view of a processing tank according to an embodiment of the present invention.

Next, as shown in FIG. 2, a feed roller structure 24 will be described by using the developing tank 20 of the processing tanks, as an example.

The developing tank 20 which contains developer serving as the processing solution for processing photographic printing paper P, is disposed within the processor section 14.A feed roller 24, which is rotatably supported by a processing rack 22 inserted in the developing tank 20, nips the photographic printing paper P and transports the photographic printing paper P by the driving force transmitted from an unillustrated drive source.

Namely, as shown in FIG. 2, the feed roller 24 is formed from a pair of rollers, each of which has a coaxially-shaped two-layer structure formed by two-layer extrusion molding using thermoplastic resin. The roller surface length 2L of a pair of rollers is each 358 mm. Also, the external diameter A of the first roller 26 of the pair of rollers is 20 mm, while the external diameter A of the second roller 28 of the pair of rollers is 30 mm.

Further, the external layer portions 26A and 28A and the internal layer portions 26B and 28B of the first roller 26 and the second roller 28, both of the rollers having the two-layer structure, are both formed with thermoplastics resin. The external layer portions 26A and 28A are formed using a simple polyphenylether substance (simply referred to as PPE hereinafter) and their modulus of elasticity is 240 kgf/mm$^2$ or more (at 23° C.), while the internal layer portions 26B and 28B are formed with PPE containing glass fillers and their modulus of elasticity is 900 kgf/mm$^2$ or more (at 23° C.).

Next, the results of the test for deciding the thickness of each layer of a feed roller 24 of the present embodiment will be described.

First, TABLE 1 shows the size of each sample, and the maximum deflection amount $\delta_{max}$ of each sample when a predetermined load F is applied to the end portions of a shaft.

TABLE 1

(The position of maximum deflection is at the center of the width of each roller)

| | External layer | | Internal layer | | Maximum |
|---|---|---|---|---|---|
| Type | Thickness | Internal diameter B | Thickness | Internal diameter C | deflection amount $\delta_{max}$ |
| ϕ20-A | 2 | 16 | 2 | 12 | 0.0187 |
| ϕ20-B | 1 | 18 | 3 | 12 | 0.0131 |
| ϕ20-C | 2 | 16 | 3 | 10 | 0.0160 |
| ϕ20-D | 1 | 18 | 4 | 10 | 0.0117 |
| ϕ30-A | 1.5 | 27 | 2.5 | 22 | 0.0028 |
| ϕ30-B | 1 | 28 | 3 | 22 | 0.0017 |
| ϕ30-C | 1 | 28 | 5 | 18 | 0.0018 |
| ϕ30-D | 1.5 | 27 | 3 | 21 | 0.0024 |
| ϕ30-E | 1.5 | 27 | 5 | 17 | 0.0017 (mm) |

Figure 3:
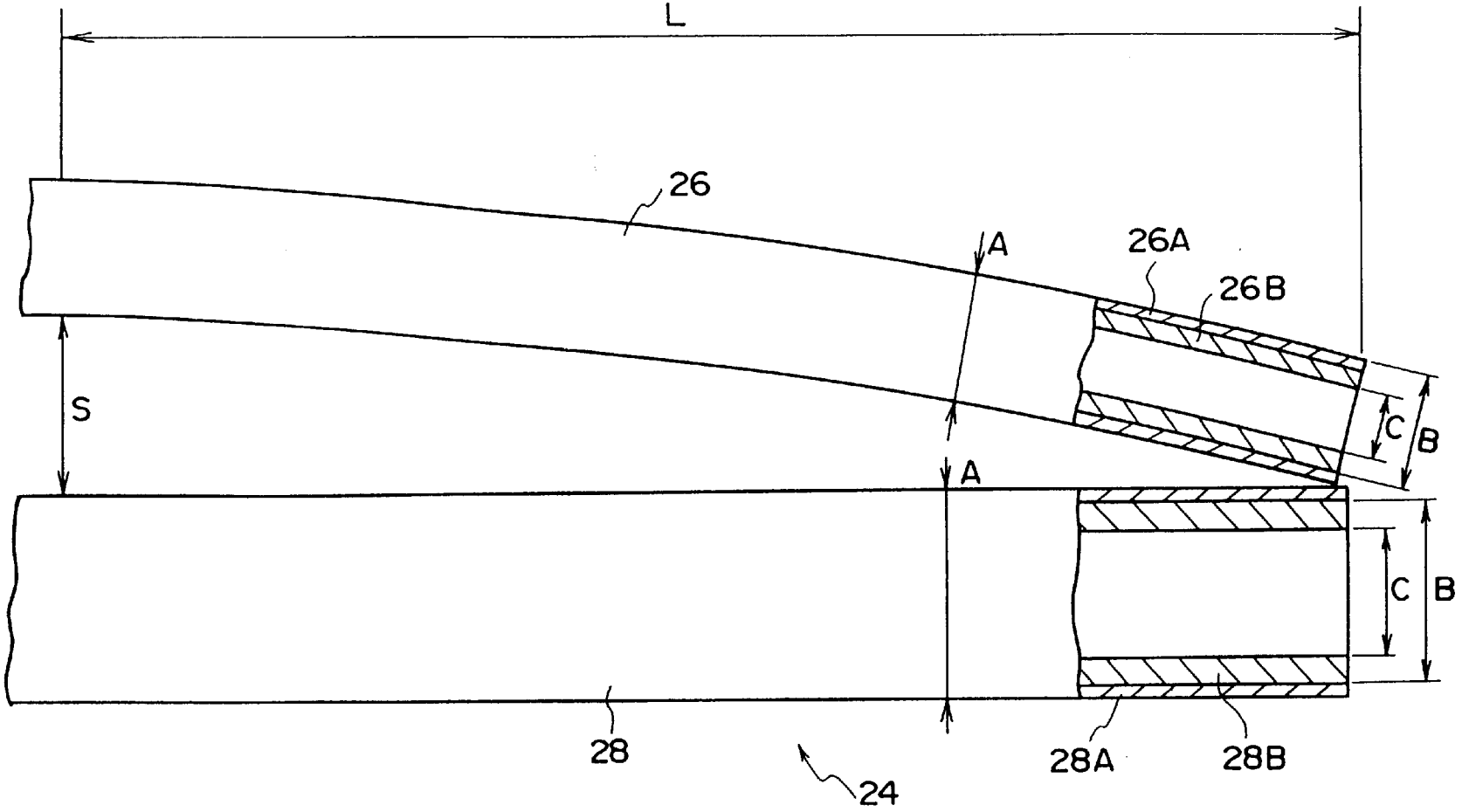
FIG. 3 is an enlarged view of a principal portion which shows a feed roller according to an embodiment of the present invention.

Here, Φ20-A, Φ20-B, Φ20-C, and Φ20-D are roller samples whose external diameters A are each 20 mm, while Φ30-A, Φ30-B, Φ30-C, Φ30-D, and Φ30-E are roller samples whose external diameters A are each 30 mm. Further, as shown in FIG. 3, B is the internal diameter of the external layer portions 26A and 28A, and C is the internal diameter of the internal layer portions 26B and 28B.

TABLE 2 shows the maximum clearance S between rollers when two rollers are combined based on the maximum deflection amount $\delta_{max}$ of each type of sample.

TABLE 2

| No. | ϕ 20 roller | ϕ 30 roller | Maximum clearance between rollers (mm) |
|---|---|---|---|
| 1 | ϕ 20-A | ϕ 30-A | 0.0215 |
| 2 | | ϕ 30-B | 0.0204 |
| 3 | | ϕ 30-C | 0.0205 |
| 4 | | ϕ 30-D | 0.0211 |
| 5 | | ϕ 30-E | 0.0204 |
| 6 | ϕ 20-B | ϕ 30-A | 0.0159 |
| 7 | | ϕ 30-B | 0.0148 |
| 8 | | ϕ 30-C | 0.0149 |
| 9 | | ϕ 30-D | 0.0155 |
| 10 | | ϕ 30-E | 0.0148 |
| 11 | ϕ 20-C | ϕ 30-A | 0.0188 |
| 12 | | ϕ 30-B | 0.0177 |
| 13 | | ϕ 30-C | 0.0178 |
| 14 | | ϕ 30-D | 0.0184 |
| 15 | | ϕ 30-E | 0.0177 |
| 16 | ϕ 20-D | ϕ 30-A | 0.0145 |
| 17 | | ϕ 30-B | 0.0134 |
| 18 | | ϕ 30-C | 0.0135 |
| 19 | | ϕ 30-D | 0.0141 |
| 20 | | ϕ 30-E | 0.0134 |

Further, the following TABLE 3 shows the weight of each type of sample, which is estimated from the specific gravity of the material.

TABLE 3

| | | | | | |
|---|---|---|---|---|---|
| | ϕ 20-A | ϕ 20-B | ϕ 20-C | ϕ 20-D | |
| Weight | 87.8 (g) | 94.5 (g) | 105.4 (g) | 112.1 (g) | |
| | ϕ 30-A | ϕ 30-B | ϕ 30-C | ϕ 30-D | ϕ 30-E |
| Weight | 148.9 (g) | 154.4 (g) | 216.1 (g) | 166.1 (g) | 226.7 (g) |

On the other hand, the thickness of the normal photographic printing paper P used in the printer-processor 10 of the present embodiment is 0.26 mm, and the thickness of the thin photographic printing paper P is 0.15 mm. In order to prevent the photographic printing paper P from slipping out from between the pair of rollers, it is preferable for the maximum clearance S between the rollers to be less than the thickness of the photographic printing paper P, and desirably, to be approximately less than one tenth of the thickness of the photographic printing paper P.

Therefore, in the light of the weight of rollers and the maximum clearance S, the combination of Φ20-B and Φ30-B is the best choice. That is, the maximum clearance S is only 0.0148 mm, which is the total amount of the maximum deflection amount $\delta_{max}$ of these rollers, and which is small enough for use. Then, Φ20-B can be used for the above-mentioned first roller 26, and Φ30-B can be used for the second roller 28.

Next, the critical values of the internal and external diameters of each layer of the feed roller 24 are determined in light of the workability in two-layer extrusion molding and the like.

Namely, with the limited molding conditions when two coaxially-shaped layers are formed by two-layer extrusion molding, the molding conditions A−B≧2 mm and C≧10 mm are established. As shown in FIG. 3, A is the external diameter of the feed roller 24, B is the internal diameter of the external layers 26A and 28A, and C is the internal diameter of the internal layers 26B and 28B. In this case, the maximum clearance S between the rollers is obtained by calculation using the following formula (1).

$$S \approx 2 \times \frac{WL^3}{3\{E_0(A^4 - B^4) + E_1(B^4 - C^4)\}} \quad (1)$$

Wherein W is 0.4 kgf, which is the maximum load at which the edge quality of the photographic printing paper P is compatible with the transporting properties of the photographic printing paper P. L is 179 mm, which is half the length of the roller surface length. $E_0$ is 240 kgf/mm$^2$, which is the modulus of elasticity of the external layer portions 26A and 28A. $E_1$ is 950 kgf/mm$^2$, which is the modulus of elasticity of the internal layer portions 26B and 28B.

Further, the maximum clearance S between the rollers must be less than 0.15 mm, which is the minimum thickness of the photographic printing paper P. Further, in light of the accuracy of the runout and the like of an assembly of the roller when assembled by mounting the shaft ends on the ends of the two layer extrusion pipe, it is desirable to reduce the clearance caused by the deflection of the pipe itself, to approximately one tenth of 0.15 mm.

Therefore, on the basis of the conditions satisfying A−B≧2 mm, C≧10 mm, and S<0.15 mm, the relation A:B:C=10:8 to 9.4:5 to 7.3 can be obtained, and $A_{min}$ as the minimum value of A can be determined as 13.7 mm. Further, the maximum value of A is determined as 45 mm from the viewpoint of designing the printer-processor 10.

The operation of the present embodiment will now be described.

The feed roller 24 has a coaxially-shaped two-layer structure formed by two-layer extrusion molding using thermoplastic resin. The modulus of elasticity of the thermoplastic resin forming the external layer portions 26A and 28A of the feed roller 24 is preferably 240 kgf/mm$^2$ or higher, the modulus of elasticity of the thermoplastic resin of the internal layer portions 26B and 28B is preferably 900 kgf/mm$^2$ or higher, and the external diameter A of the feed roller 24 is larger than 13.7 mm.

In this roller structure, the external layer portions 26A and 28A of the feed roller 24 are formed from a simple PPE substance, which is a thermoplastic resin, and the internal layer portions 26B and 28B of the feed roller 24 are formed from PPE containing glass fillers.

Therefore, as the PPE of the internal layer portions 26B and 28B is reinforced with glass fillers, a modulus of elasticity of the internal layer portions 26B and 28B of 900 kgf/mm$^2$ or higher can be achieved.

Resistance to chemicals and the ability not to adversely affect photographic characteristics are required of the feed roller used in a processing rack of a photosensitive material processing apparatus serving as the automatic developing machine. Therefore, PPE is used as the thermoplastic resin material, due to its excellent productivity when used in the manufacturing of rollers and its resistance to processing solutions (alkali and acid), and its ability not to affect the quality of the photographic materials to be processed.

Additionally, the modulus of elasticity of the non-filler PPE, which does not contain glass fibers or the like, is approximately 200 kgf/mm$^2$ or more. The three factors, namely, the above value, the formula (1), and the thickness of a roller based on the suitability for extrusion manufacturing were comprehensively studied with the results as follows:

That is, the thickness of the non-filler PPE forming the external layer portions 26A and 28A is 2 mm for the roller having a diameter of 20 mm, and is approximately 1.5 mm or less for the roller having a diameter of 30 mm. In order to reduce the deflection of the roller having an external layer of the above thickness to the target value (0.0075 mm=0.15 mm×(1/10)×(1/2)=1/2 S), approximately 240 kgf/mm$^2$ is required for the modulus of elasticity of the non-filler PPE forming the external layer portions 26A and 28A.

Further, the modulus of elasticity of the filler PPE forming the internal layer portions 26B and 28B is calculated from the above modulus of elasticity of the non-filler PPE forming the external layer portions 26A and 28A (240 kgf/mm$^2$), the target value of the roller deflection, and the formula (1). If the Φ20-A roller, which has the largest amount of deflection in TABLE 1, has a roller surface length of approximately 360 mm, the required modulus of elasticity is greater than approximately 900 kgf/mm$^2$.

As can be seen from the above description, manufacturing costs were reduced by forming the coaxially-shaped two-layer structure from PPE without inserting a metal pipe or the like into the feed roller 24, and by using PPE having a high modulus of elasticity for the internal layers 26B and 28B.

Further, the rigidity of the feed roller 24 was enhanced by using PPE having a high modulus of elasticity for the internal layer portions 26B and 28B while maintaining the minimum external diameter A of the feed roller 24 so that the photographic printing paper P can be reliably transported while the accuracy of the roller is maintained when the feed roller 24, which is rotatably supported by the processing rack 22, nips and transports the photographic printing paper P inside a developing tank 20, without the occurrence of transportation failure, inclination, meandering, and the like of the photographic printing paper P.

Further, in the present embodiment, when the external diameter of the feed roller 24 is A, the internal diameter of the external layer portions 26A and 28A is B, and the internal diameter of the internal layer portions 26B and 28B is C, their ratio is within the range of A:B:C=10:8 to 9.4:5 to 7.3. Consequently a feed roller 24 can be formed with consideration given not only to the rigidity but also to the workability thereof.

Namely, within the above range, there is sufficient flow in the resin material during the molding process to ensure that the mold is filled.

In the above embodiment, the internal layer portions 26B and 28B contain glass fillers, but they may contain other fillers, for example, carbon fibers or the like. The internal layer portions 26B and 28B may also be formed with no fillers contained therein, provided that their resin material has the predetermined modulus of elasticity.

Further, in the above embodiment, the external layer portions 26A and 28A, which are formed using PPE, may be formed using an olefinic elastomer such as polyethylene, polypropylene, or the like.

On the other hand, in the above embodiment, the modulus of elasticity of the external layer portion is lower while that of the internal layer portion is higher. Conversely, the modulus of elasticity of the internal layer portion may be lower while that of the external layer portion may be higher.

It is also apparent that the feed roller according to the present invention can be used for a feed roller not only in the developing tank but also in the bleach-fixing tank or the rinsing tank.

In summary, the feed roller structure of the present invention has the above-mentioned structure which achieves a remarkable effect wherein a photosensitive material can be reliably transported while the accuracy of the roller is maintained.

What is claimed is:

1. A method of feeding a photosensitive material in a photosensitive material processing device, comprising the steps of:

(a) providing a pair of feed rollers, each in a form of a coaxially-shaped two-layer thermoplastic resin structure formed by two-layer extrusion molding, wherein said two-layer structure of each of said feed rollers comprises an internal layer portion and an external layer portion, each of a thermoplastic resin, wherein the modulus of elasticity of either the thermoplastic resin constituting said external layer portion or the thermoplastic resin constituting said internal layer portion of said two-layer structure is 240 kgf/mm$^2$ or more, the modulus of elasticity of the thermoplastic resin constituting the other layer portion is 900 kgf/mm$^2$ or more, and the external diameter of one of said feed rollers is 13.7 mm or more;

(b) rotatably supporting the feed rollers on a processing rack inside a processing tank of said device so that the rollers oppose one another, with a clearance of no more than 0.015 mm therebetween; and (c) directing the photosensitive material between the feed rollers, while rotating at least one of the rollers, to convey the photosensitive material inside the processing tank, while limiting an applied load to no more than 0.4 kgf.

2. The method according to claim 1, wherein either one of the external layer portion and the internal layer portion of each of said feed rollers is formed using a simple thermoplastic resin substance, and the other one of either the external layer portion and the internal layer portion of each of said feed rollers is formed using a thermoplastic resin containing fillers.

3. The method according to claim 2, wherein a nip surface length of each of said feed rollers is within a range of 230 mm to 400 mm.

4. The method according to claim 3, wherein, when an external diameter of each of said feed rollers is A, an internal diameter of the external layer portion is B, and an internal diameter of the internal layer portion is C, their ratio is within a range of A:B:C=10:8–9.4:5–7.3.

5. The method according to claim 4, wherein the external layer portion of each of said feed rollers is formed using olefinic elastomer, and the internal layer portion is formed using thermoplastic resin with a modulus of elasticity of 900 kgf/mm$^2$ or more.

6. The method according to claim 2, wherein, when an external diameter of each of said feed rollers is A, an internal diameter of the external layer portion is B, and an internal diameter of the internal layer portion is C, their ratio is within a range of A:B:C=10:8–9.4:5–7.3.

7. The method according to claim 1, wherein a nip surface length of each of said feed rollers is within a range of 230 mm to 400 mm.

8. The method according to claim 7, wherein, when an external diameter of each of said feed rollers is A, an internal diameter of the external layer portion is B, and an internal diameter of the internal layer portion is C, their ratio is within a range of A:B:C=10:8–9.4:5–7.3.

9. The method according to claim 1, wherein, when an external diameter of each of said feed rollers is A, an internal diameter of the external layer portion is B, and an internal diameter of the internal layer portion is C, their ratio is within a range of A:B:C=10:8–9.4:5–7.3.

10. The method according to claim 1, wherein either one of the external layer portion and the internal layer portion of each of said feed rollers is formed using olefinic elastomer, and the other one of the external layer portion and either the internal layer portion is formed using thermoplastic resin with a modulus of elasticity of 900 kgf/mm$^2$ or more.

11. The method of feeding a photosensitive material in a photosensitive material processing device, comprising the steps of:

(a) providing a pair of feed rollers, each in a form of a coaxially-shaped two-layer thermoplastic resin structure formed by two-layer extrusion molding, said rollers which are rotatably supported on a processing rack, (b) rotatably supporting the feed rollers on a processing rack inside a processing tank of said device, so that the rollers oppose one another, with a clearance of no more than 0.15 mm therebetween; and (b) directing the photosensitive material between the feed rollers while rotating at least one of the rollers, to convey the photosensitive material inside said processing tank, while limiting an applied load to no more than 0.4 kgf, wherein said two-layer structure of each of said feed rollers comprises an internal layer portion and an external layer portion, each of a thermoplastic resin, wherein the modulus of elasticity of the thermoplastic resin constituting said external layer portion of said two-layer structure is 240 kgf/mm$^2$ or more, the modulus of elasticity of the thermoplastic resin constituting said internal layer portion of said two-layer structure is 900 kgf/mm$^2$ or more, and the external diameter of each of said feed rollers is within the range of 13.7 mm to 45 mm.

12. The method according to claim 11, wherein the external layer portion of each of said feed rollers is formed using a simple thermoplastic resin substance and the internal layer portion of each of said feed rollers is formed using a thermoplastic resin containing fillers.

13. The method according to claim 12, wherein a nip surface length of each of said feed rollers is within a range of 230 mm to 400 mm.

14. The method according to claim 13, wherein, when an external diameter of each of said feed rollers is A, an internal diameter of the external layer portion is B, and an internal diameter of the internal layer portion is C, their ratio is within a range of A:B:C=10:8–9.4:5–7.3.

15. The method according to claim 14, wherein the external layer portion of each of said feed rollers is formed using olefinic elastomer, and the internal layer portion is formed using thermoplastic resin with a modulus of elasticity of 900 kgf/mm$^2$ or more.

16. The method according to claim 12, wherein, when an external diameter of each of said feed rollers is A, an internal diameter of the external layer portion is B, and an internal diameter of the internal layer portion is C, their ratio is within a range of A:B:C=10:8–9.4:5–7.3.

17. The method according to claim 11, wherein a nip surface length of each of said feed rollers is within a range of 230 mm to 400 mm.

18. The method according to claim 17, wherein, when an external diameter of each of said feed rollers is A, an internal diameter of the external layer portion is B, and an internal diameter of the internal layer portion is C, their ratio is within a range of A:B:C=10:8–9.4:5–7.3.

19. The method according to claim 11, wherein, when an external diameter of each of said feed rollers is A, an internal diameter of the external layer portion is B, and the internal diameter of the internal layer portion is C, their ratio is within a range of A:B:C=10:8–9.4:5–7.3.

20. The method according to claim 11, wherein the external layer portion of each of said feed rollers is formed using olefinic elastomer, and the internal layer portion is formed using thermoplastic resin with a modulus of elasticity of 900 kgf/mm$^2$ or more.

* * * * *